United States Patent [19]

Kaufman et al.

[11] Patent Number: 4,862,032

[45] Date of Patent: Aug. 29, 1989

[54] END-HALL ION SOURCE

[76] Inventors: Harold R. Kaufman, 925 Columbia, Apt. 622, Fort Collins, Colo. 80525; Raymond S. Robinson, 2612 Bradbury Ct., Fort Collins, Colo. 80521

[21] Appl. No.: 920,798

[22] Filed: Oct. 20, 1986

[51] Int. Cl.[4] ..... F03H 5/00

[52] U.S. Cl. ..... 313/359.1; 60/202; 250/427; 313/230; 313/231.31; 313/161; 315/111.41; 315/111.61; 315/111.81

[58] Field of Search ..... 315/111.41, 111.51, 315/111.61, 111.81; 313/231.31, 231.41, 111.9, 161; 250/427; 60/202, 208

[56] References Cited

U.S. PATENT DOCUMENTS

| | | | |
|---|---|---|---|
| 3,309,873 | 3/1967 | Cann | 60/203.1 |
| 3,360,682 | 12/1967 | Moore | 60/202 |
| 3,388,291 | 6/1968 | Cann | 315/111.61 |
| 3,735,591 | 5/1973 | Burkhart | 60/202 |
| 3,956,666 | 5/1976 | Reader et al. | 60/202 |
| 4,104,875 | 8/1978 | Birner et al. | 60/202 |
| 4,277,304 | 7/1981 | Horiike et al. | 313/231.31 |
| 4,361,472 | 11/1982 | Morrison, Jr. | 204/192 R |
| 4,548,033 | 10/1985 | Cann | 315/111.61 |
| 4,684,848 | 8/1987 | Kaufman et al. | 313/231.31 |

FOREIGN PATENT DOCUMENTS

| | | | |
|---|---|---|---|
| 0095879 | 12/1983 | European Pat. Off. | 313/359.1 |
| 0174058 | 3/1986 | European Pat. Off. | 313/359.1 |
| 2904049 | 8/1979 | Fed. Rep. of Germany | 313/359.1 |
| 2913464 | 10/1980 | Fed. Rep. of Germany | 313/359.1 |
| 1543530 | 4/1979 | United Kingdom | 313/359.1 |

OTHER PUBLICATIONS

Vossen et al., "Thin Film Processes," Academic Press, 1978.

Morosov, "Physical Principles of Cosmic Jet Propulsion", Atomizdat, vol. 1, Moscow 1978, pp. 13–15.

4th All-Union Conference on Plasma Accelerators and ion Injectors, Notes, Moscow, 1978.

3rd All-Union Conference on Plasma Accelerators, Notes, Minsk, 1976.

Seikel et al, "Plasmas and Magnetic Fields in Propulsion and Power Research," *NASA SP*-226, Oct. 16, 1969, pp. 1–64.

Moeckel, "Proceedings of the NASA-University Conference on the Science and Technology of Space Exploration," *NASA SP*-11, Nov. 1962, pp. 153–181.

Kaufman et al, "Ion Source Design for Industrial Applications," *AIAA Journal,* vol. 20, No. 6, Jun. 1982, pp. 745–760.

*Primary Examiner*—David K. Moore
*Assistant Examiner*—Mark R. Powell
*Attorney, Agent, or Firm*—Hugh H. Drake

[57] ABSTRACT

A gas, ionizable to produce a plasma, is introduced into a region defined within an ion source. An anode is disposed near one end of that region, and a cathode is located near the other. A potential is impressed between the anode and the cathode to produce electrons which flow generally in a direction from the cathode toward the anode and bombard the gas to create a plasma. A magnetic field is established within the region in a manner such that the field strength decreases in the direction from the anode to the cathode. The direction of the field is generally between the anode and the cathode. The electrons are produced independently of any ion bombardment of the cathode, the magnet is located outside the region on the other side of the anode and the gas is introduced uniformly across the region.

21 Claims, 3 Drawing Sheets

END-HALL ION SOURCE

The present invention pertains to ion sources. More particularly, it relates to ion sources capable of producing high-current, low-energy ion beams.

Earlier work led to the development of electrically-energized ion beam sources for use in connection with vehicles moving in outer space. A plasma was produced and yielded ions which were extracted and accelerated in order to provide a thrusting force. That technology eventually led to designs for the use of ion sources in a wide range of industrial applications as referenced in *AIAA Journal*, Vol. 20, No. 6, June 1982, beginning at page 745. As there particularly discussed, ions were selected by a screen grid and withdrawn by an accelerator grid. While prior gridded ion sources were useful improvements in such applications, they led to complexity of construction and alignment together with a need to use care in handling in order not to affect such alignment. Yet, they have proved to be of value in themselves and the observation of their operation has contributed to advancement.

A wide variety of ion source shapes and arrangements have been suggested, including both angular and annular. Representative is U.S. Pat. No. 4,361,472—Morrison. Particular approaches utilizing what may be called other varieties of differently-shaped sources, including annular, are discussed and shown in U.S. Pat. No. 4,277,304—Horiike et al. Still other plasma-using ion sources were set forth in an article entitled "Plasma Physics of Electric Rockets" by George R. Seikel et al, which appeared in *Plasmas and Magnetic Fields in Propulsion and Power Research*, NASA, SP-226, 1969. While numerous ion thrusters are described, particular attention is directed to pages 14–16 and FIGS. I-16 and I-17 and the teachings with regard to the magnetoplasmadynamic arc thrusters. In addition, this article contains an extensive bibliography.

Most prior ion sources have used electromagnets for the purpose of producing the magnetic field which contains the electrons in a plasma. Again somewhat representative is the electron-bombardment engine shown and discussed at page 179 of the *Proceedings of the NASA-University Conference on Science on Technology of Space Exploration*, Vol. 2, NASA, SP-11, November 1–3, 1962. Moreover, a permanent-magnet ion engine (source) also was discussed and shown in that publication on page 180.

To offset the limitations upon gridded ion sources, others have developed what may be termed gridless ion sources. In those, the accelerating potential difference for the ions is generated using a magnetic field in conjunction with an electric current. The ion current densities possible with this acceleration process are typically much greater than those possible with the gridded sources, particularly at low ion energy. Moreover, the hardware associated with the gridless acceleration process tends to be simpler and more rugged.

One known gridless ion source is of the end-Hall type as disclosed by A. I. Morosov in *Physical Principles of Cosmic Electro-jet Engines*, Vol. 1, Atomizdat, Moscow, 1978, pp. 13–15. Also known is a closed-drift ion source in which the opening for ion acceleration is annular rather than circular. This was described by H. R. Kaufman in "Technology of Closed-drift Thrusters", *AIAA Journal*, Vol. 23, pp. 78–87, January 1985. The closed-drift type of ion source is typically more efficient for use in its original purpose of electric space propulsion. However, the extended-acceleration version of such a closed-drift ion source is sensitive to contamination from the surrounding environment, and the previously-disclosed anode-layer version of the closed-drift ion source is relatively inflexible in operation.

Additional background with respect to gridless ion sources will be found in *III All-union* 15 *Conference on Plasma Accelerators*, Minsk, 1976; and *IV All-union Conference on Plasma Accelerators and Ion Injectors*, Moscow, 1978.

A significant effort also has been made in the use of plasmas for the achievement of a fusion reaction. A mirror effect has been employed in the field of fusion machines in order to enhance ion containment. In that case, however, the magnetic field has been strong enough to directly affect the ion motion.

Of course, there are many other prior publications which mention the "Hall effect". As that effect may be observed to occur in earlier literature, it can be misleading. This application primarily pertains to the end-Hall configuration which, in itself, has already been documented as above discussed.

In light of all of the foregoing, it is an overall general object of the present invention to provide a new and improved high-current, low-energy ion-beam source.

Another object of the present invention is to provide an end-Hall source for use in property enhancement applications of the kind wherein large currents of low-energy ions are used in conjunction with the deposition of thin films to increase adhesion, to control stress, to increase either density or hardness, to produce a preferred orientation or to improve step coverage.

A further object of the present invention is to enable the provision of the device of this sort which is simple, mechanically rugged and reliable.

Still another object of the present invention is to shape and control the magnetic field in a manner better to obtain the other objectives.

Yet another object of the present invention is to ensure the movement of ions in the desired direction in order to reduce erosion caused by ions moving in the opposite direction.

In accordance with one specific embodiment of the present invention, an ion source takes a form that includes means for introducing a gas, ionizable to produce a plasma, into a region within the source. An anode is disposed within the source near one end of that region, and a cathode also is disposed within the region but spaced from the anode. A potential difference is impressed between the anode and cathode to produce electrons flowing generally in a direction from that cathode toward the anode in bombardment of the gas to create and sustain the plasma. Included with the source are means for creating within the region a magnetic field the strength of which decreases in the direction from the anode to the cathode and the direction of which field is generally between the anode and the cathode.

Leading aspects of the approach taken are that the electrons may be produced independently of any bombardment of the cathode, the magnet means may be located outside the region on the other side of the anode and the gas may be introduced and distributed uniformly transverse to that direction.

The features of the present invention which are believed to be patentable are set forth with particularity in the appended claims. The organization and manner of operation of the invention, together with further objects and advantages thereof, may be understood by reference to the following description of a specific embodiment thereof taken in connection with the accompanying drawings, in the several figures of which like reference numerals identify like elements and in which:

Figure 1:
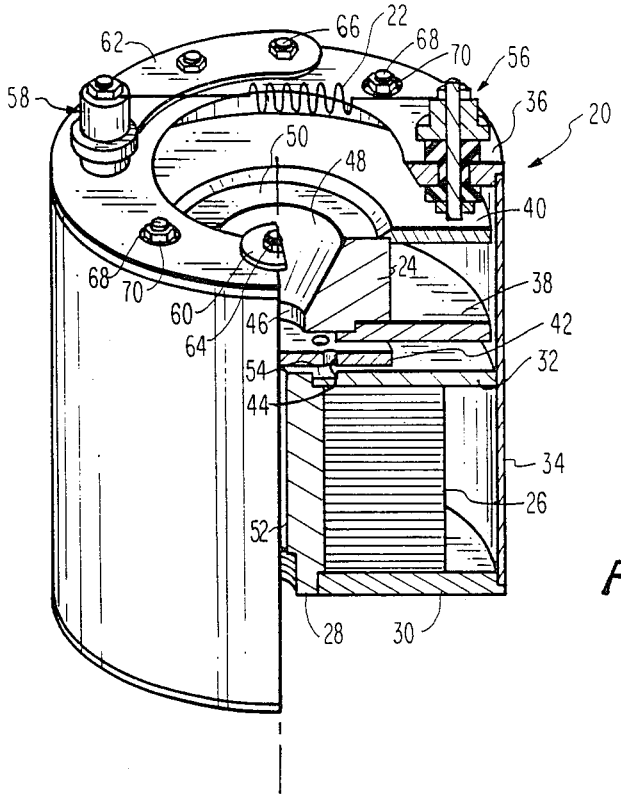
FIG. 1 is an isometric view, partially broken away into cross-section, illustrating an end-Hall ion source constructed in accordance with one specific embodiment of the present invention.

An end-Hall ion source 20 includes a cathode 22 beyond which is spaced an anode 24. On the side of anode 24 remote from cathode 22 is an electromagnet winding 26 disposed around an inner magnetically permeable pole piece 28. As shown, the different parts of the anode and magnetic assemblies are of generally cylindrical configuration which leads not only to symmetry in the ultimate ion beam but also facilitates assembly as by stacking the different components one on top of the next.

Magnet 26 is confined between lower and upper plates 30 and 32. Plate 30 is of magnetically permeable material, and plate 32 is of non-magnetic material. Surrounding anode 24 and magnet winding 26 is a cylindrical wall 34 of magnetic material atop which is secured an outer pole piece 36 again of magnetically permeable material. Anode 24 is of a non-magnetic material which has high electrical conductivity, such as carbon or a metal, and it is held in place by rings 38 and 40 also of non-magnetic material.

Held in a spaced position between plate 32 and ring 38 is a distributor 42. Circumferentially-spaced around its peripheral portion are apertures 44 located beneath anode 24 and outwardly of opening 46 into the bottom of anode 24 and from which its interior wall 48 tapers upwardly and outwardly to its upper surface 50. As will be observed in FIG. 1, the interior edge of pole piece 36 is disposed outside a projection of interior wall 48.

Disposed centrally within inner pole piece 28 is a bore 52 which leads into a manifold or plenum 54 located beneath apertures 44 through which the gas to be ionized is fed uniformly into the discharge region at opening 46.

Cathode 22 is secured between bushings 56 and 58 electrically separated from but mechanically mounted from outer pole piece 36. Bushings 56 and 58 are electrically connected through straps 60 and 62 to terminals 64 and 66. From those terminals, insulated electrical leads continue through the interior of source 20 to suitable connectors (not shown) at the outer end of the unit.

The entire assembly of the different plates and other components is held together by means of elongated bolts 68 fastened by nuts 70. This approach to assembly is convenient and simple, as well as being rugged and eliminating critical alignment of the different components. The approach also facilitates easy disassembly for cleaning of parts from time to time, an expected necessity in view of ultimate contamination such as from loose flakes of deposited material. When necessary, heat shields may be included between different parts of the assembly such as internally around anode 24 and at the back of the assembly below plate 30.

In the above discussion, use has been made of the words "above" and "below". That use is solely in accordance with the manner of the orientation shown in FIG. 1. In practice, ion source 20 may have any orientation relative to the surroundings. Moreover, wall 34 may be secured within a standard kind of flange shaped to fit within a conventional port as used in vacuum chambers.

Figure 2:
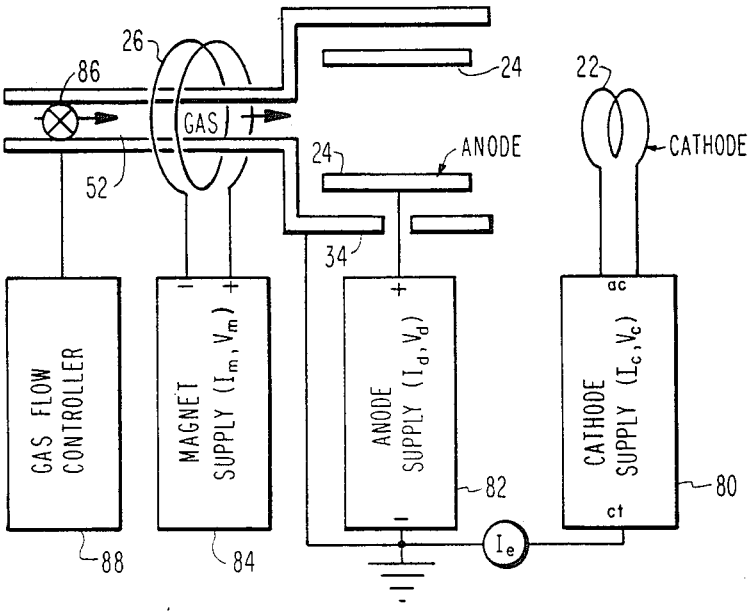
FIG. 2 is a schematic diagram of energization and control circuitry.

FIG. 2 depicts the overall system as utilized in operation. Alternating current supply 80 energizes cathode 22 with a current $I_c$ at a voltage $V_c$. A center tap of the supply is returned to system ground as shown through a meter $I_e$ which measures the electron emission from the cathode. Anode 24 is connected to the positive potential of a discharge supply 82 returned to system ground and delivers a current $I_d$ at a voltage $V_d$. Magnet 26 is energized by a direct current from a magnet supply 84 which delivers a current $I_m$ at a voltage $V_m$. The magnetically permeable structure, such as wall 34, also is connected to system ground.

A gas flow controller 88 operates an adjustable valve 86 in the conduit which feeds the ionizable gas into bore 52. Cathode supply 80 establishes the emission of electrons from cathode 22. Anode potential is controlled by all of: the anode current, the strength of the magnetic field and the gas flow.

While an electromagnet version has been shown, a permanent-magnet version also has been tested. A permanent-magnet was installed in place of winding 26 of the illustrated electromagnet and as part of inner pole piece 28. In that case, gas flow may be brought through the ion source to plenum 54 by a separate tube. Using the permanent magnet, the number of electrical power supplies was reduced, because magnet supply 84 no longer was necessary. Use of the permanent magnet had no adverse affect on the performance to be described.

Figure 3:
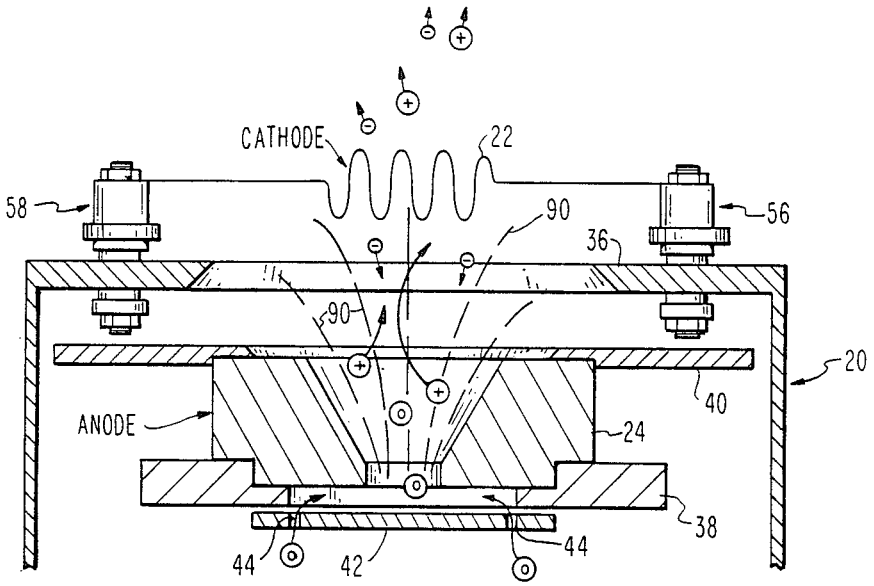
FIG. 3 is a cross-sectional view of an upper portion of that shown in FIG. 1 with additional schematic and pictorial representation.

For a generalized description of operation, reference should be made to FIG. 3. Neutral atoms or molecules are indicated by the letter "0". Electrons are depicted by the negative symbol "−" and ions are indicated by the plus sign "+".

The neutral atoms or molecules of the working gas are introduced to the ion source through ports or apertures 44. Energetic electrons from the cathode approximately follow magnetic field lines 90 back to the discharge region enclosed by anode 24, in order to strike atoms or molecules within that region. Some of those collisions produce ions. The mixture of electrons and ions in that discharge region forms a conductive gas or plasma. Because the density of the neutral atoms or molecules falls off rapidly in the direction from the anode toward the cathode, most of the ionizing collisions with neturals occur in the region laterally enclosed by anode 24.

The conductivity parallel to the magnetic field is much higher than the conductivity across that field. Magnetic field lines 90 thus approximate equipotential contours in the discharge plasma, with the magnetic field lines close to the axis being near cathode potential and those near anode 24 being closer to anode potential. Such a radial variation in potential was found to exist by the use of Langmuir probe surveys of the discharge. It was also found that there is a variation of potential along the magnetic field lines, tending to accelerate ions from the anode to the cathode. The cause of this variation along magnetic field lines is discussed later. The ions that are formed, therefore, tend to be initally accelerated both toward the cathode and toward the axis of symmetry. Having momemtum, those ions do not stop at the axis of the ion source but continue on, often to be reflected by the positive potentials on the opposite side of the axis. Depending upon where an ion is formed, it may cross the axis more than once before leaving the ion source.

Because of the variety of the trajectories followed, the ions that leave the source and travel on outwardly beyond cathode 22 tend to form a broad beam. The positive space charge and current of the ions of that broad beam are neutralized by some of the electrons which leave cathode 22. Most of the electrons from cathode 22 flow back toward anode 24 and both generate ions and establish the potential difference to accelerate the ions outwardly past cathode 22. Because of the shape of the magnetic field and the potential gradient between the anode and cathode, most of the ions that are generated leave in the downstream direction.

The current to the anode is almost entirely composed of electrons, including both the original electrons from cathode 22 and the secondary electrons that result from the ionization of neutrals. Because the secondary electron current to anode 24 equals the total ion production, the excess electron emission from cathode 22 is sufficient to current-neutralize the ion beam when the electron emission from cathode 22 equals the anode current.

The cathode emission $I_e$ can be considered as being made up of a discharge current $I_d$ that flows back toward the anode and a neutralizing current $I_n$ that flows out with the ion beam:

$$I_e = I_d + I_n. \tag{1}$$

Because the ions that are formed are directed by the radial and axial electric fields to flow almost entirely into the ion beam, the current $I_a$ to the anode is primarily due to electrons. This electron current is made up of the discharge current $I_d$ from the cathode plus the secondary electon current $I_s$ from the ionization process, or:

$$I_a = I_d + I_s. \tag{2}$$

Equating $I_e$ and $I_a$ then gives:

$$I_n = I_s. \tag{3}$$

From conservation of charge, the ion-beam current $I_b$ equals the current $I_s$ of secondary electrons, so that:

$$I_n = I_b. \tag{4}$$

For the condition of equal electron emission and anode current, then, the electron current available for neutralizing the ion beam equals the ion-beam current.

Apart from the foregoing general description of the ion production process, it is instructive to consider that which occurs in more detail. There are two major mechanisms by which the potential difference which accelerates the ions is generated by a magnetic field generally of the diverging shape as shown in FIG. 3. The first of those mechanisms is the reduced plasma conductivity across magnetic field lines 90. The strong-field approximation is appropriate for the typical field strength of several hundred Gauss (several times $10^{-2}$ Tesla) used in the disclosed end-Hall source. The ratio of conductivity parallel to the magnetic field to that transverse thereto is, thus, expressed:

$$\sigma_{\parallel}/\sigma_{\perp} = (\omega/\nu)^2, \tag{5}$$

where $\omega$ is the electron cyclotron frequency and $\nu$ is the electron collision frequency. The electron collision frequency is usually determined by the plasma fluctuations of anomalous diffusion when conduction is across a strong magnetic field. Using Bohm diffusion to estimate that frequency, it can be shown that;

$$\sigma_{\parallel}/\sigma_{\perp} = 256. \tag{6}$$

Because Bohm diffusion is typically accurate only within a factor of several, the ratio expressed in equation (6) should be treated as correct only within an order of magnitude. Even so, it is expected that:

$$\sigma_{\parallel} >> \sigma_{\perp}. \tag{7}$$

From this difference in conductivity parallel and normal to the magnetic field, it should be expected that the magnetic field lines as shown in FIG. 3 would approximate equipotential contours in the plasma. Further, the field lines closer to the anode would be more positive in potential. Radial surveys of plasma potential have been made using a Langmuir probe. Those surveys showed some potential increase in moving off the longitudinal axis defined by the concentricity of anode 24 to a magnetic field lying close to anode 24. However, the increase was found to be only a fraction of the total anode-cathode potential difference. The bulk of the latter potential difference appeared in the axial direction. That is, a major portion of the difference appeared to be parallel to the magnetic field where, from equation (7), the potential difference might otherwise be expected to be small.

The time-averaged force of a non-uniform magnetic field on an electron moving in a circular orbit within source 20 is of interest. For a variation of field strength in only the direction of the magnetic field, that force is parallel to the magnetic field and in the direction of decreasing field strength. Assuming an isotropic distribution of electron velocity, two-thirds of the electron energy is associated with motion normal to the magnetic field, so as to interact with that field. With the assumption of a uniform plasma density, the potential difference in the plasma is calculable by integrating the electric field required to balance the magnetic-field forces on the electron, yielding:

$$\Delta V_p = (kT_e/e) \ln (B/B_o), \tag{8}$$

where k is the Boltzman constant, $T_e$ is the electron temperature in K, e is the electron charge and B and $B_o$ are the magnetic field strengths in two locations. The grouping, $kT_e/e$ is the electron temperature in electron-Volts. Assuming B>Bo, the plasma potential at B is greater than that at Bo.

Axial surveys of plasma potential in the described end-Hall source are found to be in approximate agreement with equation (8). It is noted that there is an additional effect of plasma density on potential, and a more complete description of the variation of plasma potential with magnetic field strength would also have to include that effect.

Variation of plasma potential as given by equation (8) is significant in that it enables control of the acceleration of the ions by a variation in the plasma potential parallel to the magnetic field, which is caused by the interaction of electrons with the magnetic field. This is different from high-energy applications as in fusion, where the magnetic field is strong enough to act directly on the ions. The latter is called the "mirror effect" and is described by a different equation.

Figure 4:
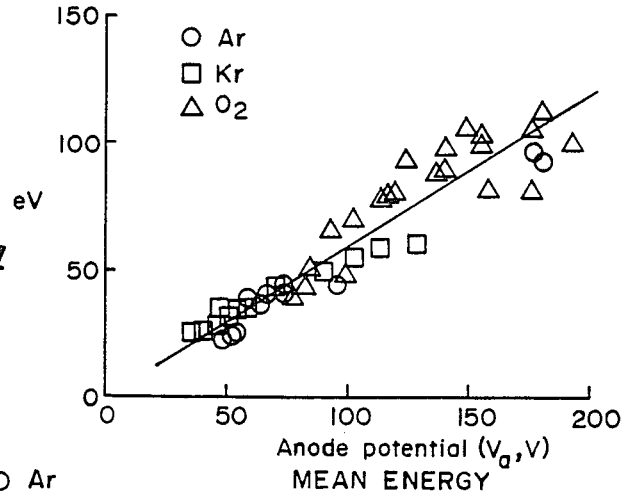
FIGS. 4–7 are graphical representations depicting operational characteristics of the device of FIG. 1.
Figure 5:
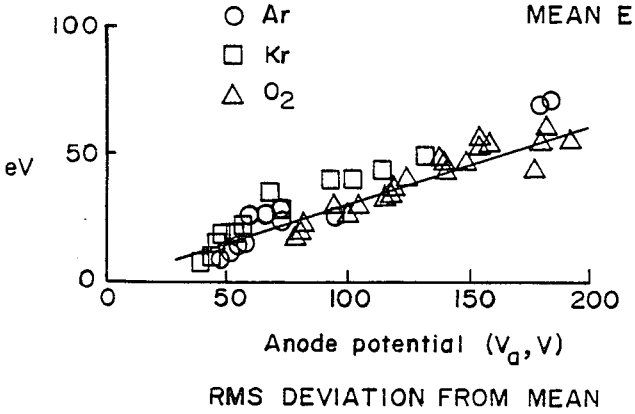

The ions are at least primarily generated in the discharge plasma within anode 24 and accelerated into the resultant ion beam. The potential of the discharge plasma extends over a substantial range. As a result, the ions have an equivalent range of kinetic energy after being accelerated into the beam. The distribution of ion energy on the axis of the ion beam has been measured with a retarding potential probe. With the assumption of singly-charged ions, the retarding potential, in Volts, can be translated into ion kinetic energy as expressed in electron-Volts. Kinetic energy distributions obtained in this matter have been characterized in terms of mean energy and the rms derivations from mean energy and are depicted in FIGS. 4 and 5 for a wide range of operating conditions. It is found that the mean energy (in electron-Volts) typically corresponds to about sixty-percent of the anode potential (in Volts), while the rms deviation from the mean energy corresponds to about thirty-percent in the apparatus of the specific embodiment.

As indicated above, the mean energies were obtained on the ion-beam axis. The mean off-axis values were found to be similar but were often several electron-Volts lower. Charge-exchange and momentum-exchange processes with the background gas in the vacuum chamber result in an excess of low-energy ions at large angles to the beam axis. These processes are believed to be the cause of most, or all, of the observed variation and mean energy with off-axis angle.

Figure 6:
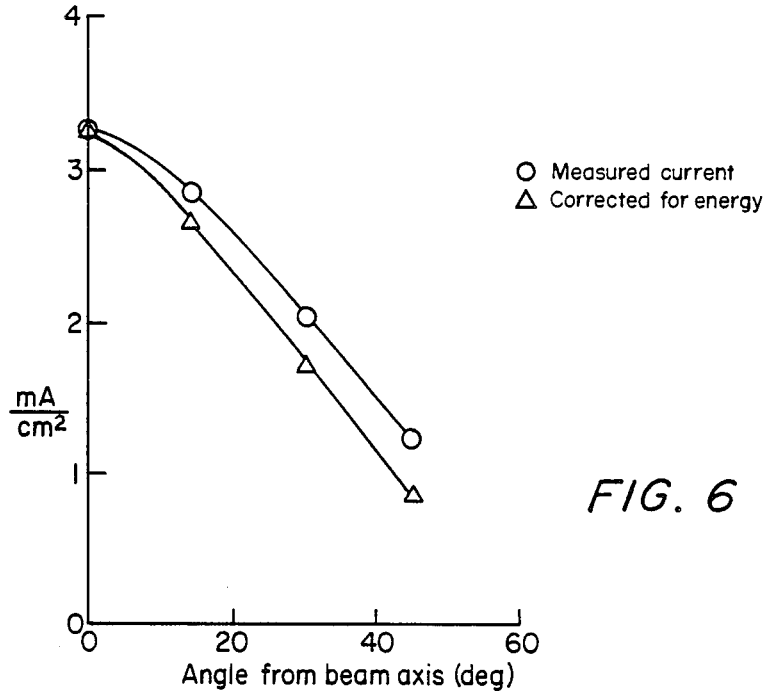

Some processes depend on the ion current density, while some depend more on the kinetic energy of the ions. The variations of both ion current density and the current density corrected for kinetic energy are therefore of interest, and both are depicted in FIG. 6 at a typical operating condition. The correction for energy was obtained by multiplying the measured off-axis current density by the ratio of off-axis to on-axis mean energies.

Figure 7:
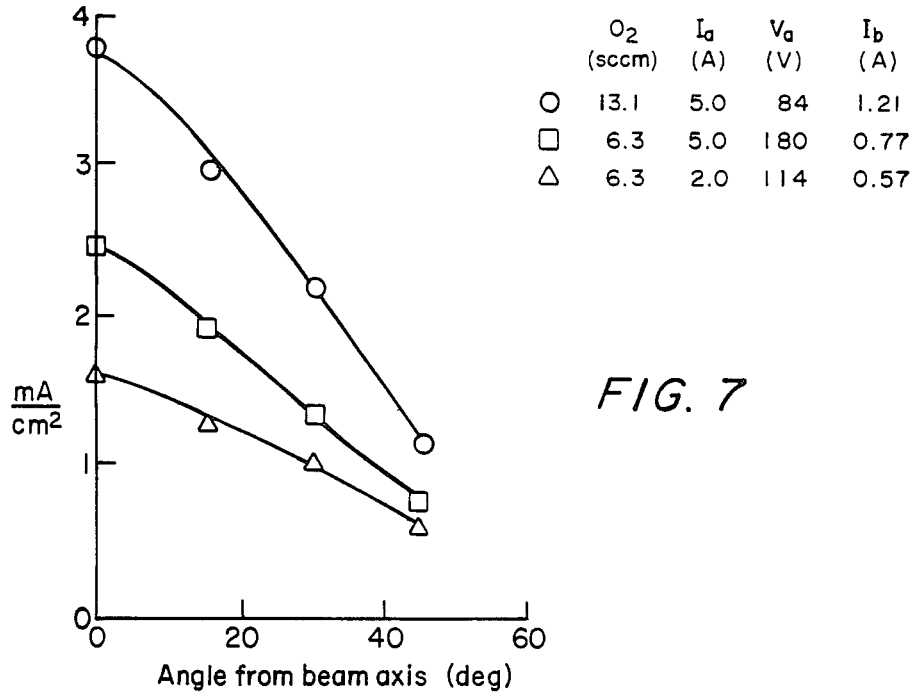

Several ion beam profiles obtained at a distance of fifteen centimeters from source 20 are presented in FIG. 7. To assure a conservative measure of current density, those profiles are corrected for energy as described above. Only half-profiles are shown in FIGS. 6 and 7, because only minor differences were found as between the two sides of the axis.

It was noted that the angular spread of the profiles shown in FIG. 7 were generally greater than that which earlier have been found to exist for gridded sources. To avoid vignetting of the probe surface by the electron-control screen in front of the probe at large angles, the probe was pivoted during these measurements about the center of the axis plane at a constant difference from that center. Because ions tend to follow narrowly straight-line trajectories, the angular variation is believed to be similar at larger distances, but the intensity would vary inversely as the square of the distance.

The ion beam profiles obtained from the end-Hall source of the present specific embodiment, can be approximated with $$i_\alpha = A \cos^n \alpha, \tag{9}$$

where A depends on beam intensity, n is a beam-shape factor, and $\alpha$ is the angle from the beam axis.

For profiles corrected in accordance with off-axis energy variation, as also indicated in FIG. 7, values of n typically range from two to four. The beam currents as presented in FIGS. 6 and 7 were obtained by using the approximation of equation (9) and integrating the corrected current density over an angle $\alpha$ from zero to ninety degrees.

Analysis of the discharge process had indicated that neutralization should be obtained when the cathode emission is approximately equal to the anode current. This has been verified with potential measurements using an electrically isolated probe in the ion beam.

Cathode lifetime tests were conducted with argon. Using tungsten cathodes with a diameter of 0.50 mm (0.020 inch), lifetimes of twenty to twenty-two hours were obtained at an anode current of five amperes which corresponded to an ion beam current of about one ampere. Lifetime tests were also conducted with oxygen, again using the same type of tungsten cathode. With oxygen, lifetimes at an anode current of five amperes range from nine to fourteen hours.

Tests have also been conducted with use of a hollow cathode. Using oxygen as a working gas for the ion source, ion source operation was found to be similar to that when using a tungsten cathode. Experience with operation using hollow cathodes in similar vacuum environments indicates that a lifetime of fifty to one-hundred hours, or more, might be expected. While the inert-gas flow to the hollow cathode would, to some extent, dilute the oxygen or any other reactive gas employed for plasma production, it is to be noted that the hollow-cathode gas flow was introduced at a considerable distance from the main discharge within anode 24. Accordingly, only a fraction of the inert gas would return to the discharge region to be ionized.

Another consideration with respect to any ion source is contamination of the target. To obtain contamination estimates on the specifically disclosed device, duration tests were conducted at an anode potential of 120 V to permit measurements of weight loss or dimension changes. Conservative calculations were used to translate those measurements into arrival rates at the target. For example, the cathode weight loss was assumed to be distributed in a uniform spherical manner, although the bombardment by beam ions probably results in the preferential sputtering of material away from the target. Those arrival rates were then expressed as atom-to-ion arrival ratios at the target.

The components considered as possibly subject to erosion are the cathode 22, distributor 42 and anode 24. Using argon, the impurity ratios for those three components were, respectively, $\leqq 4\times10^{-4}$ with a tungsten cathode, $\leqq 13\times10^{-4}$ for a carbon distributor and $\sim 0$ for a carbon anode. Using oxygen, the ratios were $\leqq 17\times10^{-4}$ for a tungsten cathode $\leqq 3\times10^{-4}$ for a stainless steel distributor and $\leqq 2\times10^{-4}$ for a stainless steel anode.

It should be noted that the use of a hollow cathode could eliminate the cathode as a contamination source. This would leave only the smaller contributions of the distributor and the anode. Of course, other materials may be used in the alternative for construction of either the distributor or the anode. In any event, contamination is generally low, making the source suited for many applications.

While the specific approach to construction of this particular kind of ion source may be varied, there are several salient features considered to be important. Therefore, they will now be summarized.

It becomes apparent from equation 8 that the operation of the present end-Hall source benefits greatly from the fact that the cathode is placed downstream in the direction of ion flow in a region of low magnetic field. The inner pole piece 28, or the equivalent permanent magnet, increses the magnetic field strength at what might be called the back of the discharge region within anode 24. On the other hand, outer pole piece 36, and its arrangement with respect to the flux path provided, decreases the field strenth near the cathode. Those two effects, taken together, result in an increased ratio of field strength in a direction from cathode 22 to the discharge region.

One result of that increased ratio is the creation of a potential gradient in the plasma which tends to direct the ions outward from source 20 into a beam. Through the effect on the potential distribution and, therefore, on the ions, that effect is used to direct the ions in the desired direction. This reduces the effect of erosin which would be caused by ions moving in the opposite direction and striking interior portions of source 20.

In the present approach, permeable material is used to shape and control the magnetic field. That is, it is a ferromagnetic material that exhibits a relative permeability (with reference to a vacuum) that is substantially greater than unity and preferably at least one or two orders of magnitude greater.

Distributer 42 is located behind the anode (opposite the direction of the cathode 22.) Ion source 20 has been operated with that distributor at ground potential, typically the vacuum chamber potential, and to which ground the center tap of the cathode is attached. In normal operation, ground is usually within several volts of the potential of the ion beam. With that manner of operation, it was found that the distributor could be struck by energetic ions in the discharge region, so that sputtering due to those collisions could become a major source of sputter contamination from source 20 itself.

Of course, such contamination is undesirable, because it is included in any material that is deposited near source 20. In the presently preferred approach, any such sputtering of distributor 42 is greatly reduced, in one measured case by a factor of about fifteen, by electrically isolating distributor 42. When isolated, distributor 42 electrically floats at a positive potential. This reduces the energy of the positive ions striking it and probably also reduces the number of ions which may strike it.

In an alternative, others of the conductive elements within the established magnetic field may be electrically isolated from the anode and the cathode, thereby being allowed to float electrically. That also may include additional field shaping elements located between the anode and the cathode.

As described, gas distribution is controlled so that most of the gas flow passes through anode 24. Because the electrons can cross the magnetic field easier by going downstream, crossing and then returning to the anode, increased plasma density downstream of the anode provides a lower impedance path and reduces the operating voltage necessary. Plasma density in a region can be controlled by controlling the gas flow to that region. Thus, the gas distribution may be used to control the operating voltage. As may be observed in FIG. 1, rings 38 and 40 are spaced inwardly from wall 34. This provides the flow path into the downstream region for enabling such control of the operating voltage.

That the magnetic field is easier to cross in the downstream region occurs because the magnetic integral, $\int \bar{B} \times d\bar{x}$, is less between the same field lines in that region. For example, if the radius of the outer field line is doubled, the distance between the axis and that radius is doubled, but the field strength between is decreased by a factor of four. For further discussion of the integral of field strength and distance, which in this case is cut in half, reference is made to the aforementioned *AIAA Journal* Volume 20, No. 6 of June 1982, at page 746.

As specifically illustrated, source 20 and all essential elements, except cathode 22, are circular or annular in shape. Accordingly, the ion beam produced exhibits a circular cross-section across its width or diameter. This ordinarily is suitable for most bombardment uses.

In some applications, however, it may be preferable to present a beam pattern which is elliptical or even rectangular. For example, when a strip of material is moved through the ion beam, a narrow but wide beam pattern may be more suitable. That is accomplished by changing the shape of anode 24 to be elliptical or rectangular rather than annular as specifically illustrated in FIG. 1.

It will thus be seen that the objectives set forth in the introduction are achieved. In some cases, the achievement has been in the nature of an improvement of prior ion sources both of the gridded and the gridless types. At the same time, some salient and unique features have been described.

While a particular embodiment of the invention has been shown and described, and alternatives have at least been mentioned, it will be obvious to those skilled in the art that changes and modifications may be made without departing from the invention in its broadest aspects. Therefore, the aim in the appended claims is to cover all such changes and modifications as fall within the true spirit and scope of that which is patentable.

We claim:

1. An ion source comprising:

means for introducing and distributing a gas, ionizable to produce a plasma, uniformly in a transverse direction across a region within said source;

an anode disposed within said source near one longitudinal end of said region;

a cathode disposed near the other longitudinal end of said region and spaced from said anode;

means for impressing a potential difference between said anode and said cathode to produce electrons flowing generally in a longitudinal direction from said cathode toward said anode in bombardment of said gas to create said plasma, the production of said electrons being independent of any substantial bombardment of said cathode by ions in said plasma;

and means included within said source for establishing within said region a magnetic field the strength of which decreases in the direction from said anode to said cathode and the direction of which field is generally between said anode and said cathode, said establishing means including a magnet located entirely outside of and on the side of said anode away from said region in said longitudinal direction.

2. An ion source comprising:
means for introducing a gas, ionizable to produce a plasma, into a region within said source;
an anode disposed within said source near one end of said region;
a cathode disposed near the other end of said region and spaced from said anode;
means for impressing a potential difference between said anode and said cathode to produce electrons flowing generally in a direction from said cathode toward said anode in bombardment of said gas to create said plasma, the production of said electrons being substantially independent of any bombardment of said cathode by ions in said plasma;
and means included within said source for establishing within said region a magnetic field the strength of which continually decreases in the direction from said anode to said cathode and the direction of which field is generally between said anode and said cathode.

3. An ion source comprising:
means for introducing a gas, ionizable to produce a plasma, into a region within said source;
an anode disposed within said source near one end of said region;
a cathode disposed near the other end of said region and spaced from said anode;
means for impressing a potential between said anode and said cathode to produce electrons flowing generally in a longitudinal direction from said cathode toward said anode in bombardment of said gas to create said plasma;
and means included within said source for establishing within said region a magnetic field the strength of which decreases in the direction from said anode to said cathode and the direction of which field is generally between said anode and said cathode, said establishing means including a magnet located entirely outside of and on the side of said anode away from said region in said longitudinal direction.

4. An ion source comprising:
means for introducing and distributing a gas, ionizable to produce a plasma, uniformly in a transverse direction across a region within said source;
an anode disposed within said source near one longitudinal end of said region;
a cathode disposed near the other longitudinal end of said region and spaced from said anode;
means for impressing a potential between said anode and said cathode to produce electrons flowing generally in a longitudinal direction from said cathode toward said anode in bombardment of said gas to create said plasma;
and means included within said source for establishing within said region a magnetic field the strength of which decreases in the direction from said anode to said cathode and the direction of which field is generally between said anode and said cathode.

5. An ion source as defined in claims 2, 3 or 4 in which said establishing means includes a ferromagnetic material, having a permeability substantially greater than unity, to shape and control the distribution of strength within said magnetic field, and in which said ferromagnetic material, completing the magnetic flux return path outside of said region, exhibits a relative permeability of at least approximately two orders of magnitude greater than unity.

6. An ion source as defined in claims 2, 3 or 4 wherein said establishing means includes at least one element which is electrically isolated from said anode and said cathode.

7. An ion source as defined in claims 2, 3 or 4 in which said establishing means establishes a plasma potential that varies laterally of the path between said anode and said cathode but a fraction of and substantially less than the plasma potential difference between the vicinity of said cathode and the vicinity of said anode, said lateral variation of plasma potential serving to control focusing or defocusing of the ion beam.

8. An ion source as defined in claims 2, 3 or 4 in which said anode is generally cylindrical in shape with an interior wall which tapers outwardly in a direction toward said cathode.

9. An ion source as defined in claims 2, 3 or 4 in which said establishing means includes a first annular pole piece disposed on the side of said anode away from said region and adjacent to and axially aligned with said anode and a second annular pole piece spaced from said first pole piece toward said cathode and axially aligned with said anode.

10. An ion source as defined in claim 9 in which said anode is generally cylindrical in shape, and in which the interior of said second pole piece is disposed to be outside a projection of the interior wall of said anode toward said cathode.

11. An ion source as defined in claim 2, 3 or 4 in which said establishing means further includes means for distributing said field through said region.

12. An ion source as defined in claims 2 or 4 in which said establishing means includes means for developing said field and which is located on the side of said anode remote from said cathode.

13. An ion source as defined in claim 2 in which said cathode is electrically heated by an external power source and is located downstream in the flow of ions created within said plasma and at a location wherein the strength of said magnetic field is low relative to the strength of said field elsewhere within said region.

14. An ion source as defined in claim 4 in which said introducing means includes means for controlling the distribution of said gas in order to control the density of said plasma downstream from said anode in the direction of ion flow and thereby control the anode-cathode potential difference.

15. An ion source as defined in claim 4 in which said introducing and distributing means includes means for distributing said gas substantially uniformly in passage through the portion of said region significantly and directly influenced by said anode.

16. An ion source as defined in claim 4 which further includes means for introducing a portion of said gas into said region between said cathode and said anode.

17. An ion source as defined in claim 4 in which said introducing means is electrically isolated from said anode and said cathode.

18. An ion source as defined in claim 4 in which said anode is cylindrical in shape and said gas is introduced into said region through said anode from the end of said anode remote from said cathode.

19. An ion source as defined in claim 18 in which said establishing means includes a first annular pole piece disposed on the side of said anode away from said region and adjacent to and axially aligned with said anode and a second annular pole piece spaced from said first pole piece toward said cathode and axially aligned with said anode.

20. An ion source as defined in claim 4 in which said anode is of cylindrical shape to produce an ion beam of circular cross-sectional shape across its diameter.

21. An ion source as defined in claim 2, 3, or 4 in which the potential difference $V_p$ along the direction between said anode and said cathode is expressed substantially in accordance with the relationship $$\Delta V_p = (kT_e/e) \ln (B/B_o),$$

where K is the Boltzman constant, $T_e$ is the electron temperature in K, e is the electron charge and B and $B_o$ are the magnetic field strengths in two locations spaced apart along said direction.

* * * * *